US008273189B2

(12) United States Patent
Derule et al.

(10) Patent No.: US 8,273,189 B2
(45) Date of Patent: Sep. 25, 2012

(54) METHOD FOR TREATING METAL SURFACES BY CARBOXYLATION, USE OF THE METHOD FOR TEMPORARY PROTECTION AGAINST CORROSION, AND METHOD FOR MANUFACTURING A SHAPED METAL SHEET THUS CARBOXYLATED

(75) Inventors: Herve Derule, Montoy Flanville (FR); Lydia Rachiele, Rombas (FR); Sophie Jacques, Le Creusot (FR); Nicole Genet, Villeurbanne (FR); Jean Steinmetz, Laxou (FR); Emmanuel Rocca, MailleLoy (FR)

(73) Assignees: ArcelorMittal France, Saint Denis (FR); Total France, Puteaux (FR)

( * ) Notice: Subject to any disclaimer, the term of this patent is extended or adjusted under 35 U.S.C. 154(b) by 377 days.

(21) Appl. No.: 12/421,253

(22) Filed: Apr. 9, 2009

(65) Prior Publication Data

US 2009/0242079 A1 Oct. 1, 2009

Related U.S. Application Data

(63) Continuation of application No. 12/097,906, filed as application No. PCT/FR2006/002814 on Dec. 20, 2006, now abandoned.

(30) Foreign Application Priority Data

Dec. 22, 2005 (EP) ..... 05292773

(51) Int. Cl.
*C23C 22/48* (2006.01)
*C23C 22/00* (2006.01)

(52) U.S. Cl. ..... 148/252; 148/274; 106/14.05; 106/14.11; 106/14.13; 106/14.44

(58) Field of Classification Search ..... 148/252, 148/274; 106/14.05, 14.11, 14.13, 14.44
See application file for complete search history.

(56) References Cited

FOREIGN PATENT DOCUMENTS

| | | | |
|---|---|---|---|
| EP | 0 301 120 | A1 | 2/1989 |
| EP | 0 897 969 | A1 | 2/1999 |
| FR | 2 141 934 | A | 1/1973 |
| GB | 792 813 | A | 4/1958 |
| GB | 2 268 512 | A | 1/1994 |

*Primary Examiner* — Lois Zheng
(74) *Attorney, Agent, or Firm* — Sughrue Mion, PLLC

(57) ABSTRACT

The invention relates to a method for the carboxylation conversion of a metal surface under oxidizing conditions in relation to the metal, consisting in bringing the metal into contact with a hydro-organic or aqueous bath containing a mixture of organic acids. The invention is characterized in that; the organic acids comprise saturated linear carboxylic acids having between 10 and 18 carbon atoms; the mixture comprises a binary or ternary mixture of such acids; the respective proportions of said acids are such that (i) for a binary mixture x±5%–y±5%, wherein x and y represent the respective proportions, in molar percentages, of the two acids in a mixture with the composition of the eutectic and (ii) for a ternary mixture x±3%–y±3%–z±3%, wherein x, y and z represent the respective proportions, in molar percentages, of the three acids in a mixture with the composition of the eutectic; and the concentration of the mixture in the bath is greater than or equal to 20 g/l.

19 Claims, 7 Drawing Sheets

METHOD FOR TREATING METAL SURFACES BY CARBOXYLATION, USE OF THE METHOD FOR TEMPORARY PROTECTION AGAINST CORROSION, AND METHOD FOR MANUFACTURING A SHAPED METAL SHEET THUS CARBOXYLATED

CROSS-REFERENCE TO RELATED APPLICATIONS

This application is a continuation of U.S. application Ser. No. 12/097,906 filed Jun. 18, 2008, now abandoned which is a National Stage of International Application No. PCT/FR2006/002814 filed on Dec. 20, 2006, claiming priority based on European Patent Application No. 05292773.8, filed Dec. 22, 2005, the contents of all of which are incorporated herein by reference in their entirety.

The invention concerns a method for the formation of conversion layers on a metal surface selected from zinc, iron, aluminium, copper, lead and their alloys, and also on galvanized, electrozinced, aluminized or copper-plated steels, making it possible to produce, at high speed, conversion layers formed of crystals of very small size, from 1 to 20 μm.

When they are applied before the shaping of the metal sheet, these conversion treatments of metal surfaces generally have at least one of the following effects:

- improvement of the friction properties under lubrication in machinery, for example for drawing of the metal sheets, without having recourse to polluting mineral oils;
- temporary protection against corrosion, the conversion layer being easily eliminated when it is no longer useful.

For this first type of application, treatments may be used that are identical to the treatments which are customarily termed pre-phosphatisation and lead to the deposition of a layer of metal phosphate, the G.S.M. (layer weight) of which is of the order of 1 to 1.5 g/m$^2$.

These different conversion treatments generally consist of anodic dissolution of the metal elements of the surface, followed by precipitation onto the surface of the compounds formed by the reaction of the dissolved metal elements with the species present in the conversion bath. Dissolution necessitates creating oxidizing conditions in relation to the metal of the surface, and generally takes place in an acid medium. The precipitation of the metal compounds to form the conversion layer requires a sufficiently high concentration and is facilitated by a medium that has become locally less acid under the action of the dissolution of the metal. It is the nature and the structure of the compounds precipitated on the treated surface which determine the degree of protection against corrosion, of improvement of the tribologic properties and/or of adhesion, and also the other properties of the layer.

In order to effect surface oxidation of the metal of the surface to be treated, and to facilitate its dissolution, it is possible to proceed chemically or electrochemically, by means of a chemical agent for oxidation of the metal which is introduced into the treatment solution, and/or by electrical polarisation of the surface while subjecting it to the action of the treatment solution.

Besides an optional oxidizing agent, the conversion baths substantially contain anions and cations capable of forming insoluble compounds with the dissolved metal of the surface. The main conversion treatments applied to steels are thus chromatization on steel that is zinced (by dip-galvanising or electrozincing) or aluminized, phosphatisation on bare non-alloy steels or coated steels, or oxalation on alloy steels such as stainless steels, for example.

After being brought into contact with a conversion bath, the treated surface is generally rinsed to eliminate the components of the surface and/or of the treatment solution which have not reacted, then the surface is dried, especially in order to harden the conversion layer and/or to improve the properties thereof.

The application conditions, the nature and the concentration of the additives have a great influence on the structure, the morphology and the density of the conversion layer obtained, and therefore on its properties.

The conversion treatment may itself be preceded by a pre-treatment, generally consisting of prior degreasing and rinsing of the surface, followed by an operation termed refining by means of a pre-treatment solution suitable for creating and/or promoting germination sites on the surface to be treated.

To this end, there are commonly used, as the refining solution on zinced surfaces, sols or colloidal suspensions of titanium salts which make it possible to obtain, subsequently, a conversion layer having smaller crystals in a denser layer.

At the end of the conversion treatment, it is also possible to carry out an after-treatment in order to improve the properties of the conversion layer. Thus, it is possible to carry out an after-treatment of chromatization on a conversion layer obtained by phosphatisation.

The different treatments of the prior art, such as chromatization, phosphatisation and oxalation treatments, have a major drawback, which is the toxicity of these products in relation to persons and the environment in general. In addition, when metal sheets bearing such conversion layers are spot-welded, toxic fumes are given off.

In the document WO-A-02/677324 it is proposed to use a carboxylation treatment to effect the conversion of the metal surfaces. To this end, conversion layers are formed by bringing the surface into contact with an aqueous, organic or hydro-organic bath comprising one or more carboxylic acids in solution or emulsion at a concentration of at least 0.1 mols/liter, under oxidizing conditions in relation to the metal surface. The acid or acids are saturated or unsaturated aliphatic monocarboxylic or dicarboxylic acids.

The precise treatments used hitherto and which had recourse to this latter technique provided satisfactory results from many points of view, but need to be improved further on certain points.

The best results have hitherto been obtained by the use of a hydro-organic bath containing, therefore, in addition to water, an organic co-solvent which it would be desirable, optimally, to dispense with, especially in order to simplify the preparation of the treatment solution and to improve hygiene and safety in workshops. Then a mixture would be retained comprising only water, the organic acid or acids, the optional oxidizing agent and a surfactant, this mixture constituting an emulsion.

Moreover, the appearance has been observed, on the processing lines using the known carboxylation solutions and emulsions, of a phenomenon termed "powdering" which is attributed to the fragility of the soap crystals of the coating during the winding of the coils of sheet metal or during contact with the shaping tools. This phenomenon results from the significant friction exerted on the metal surface during these operations. Thus, during the shaping of a zinced metal sheet, the latter becomes covered with a powder consisting of zinc-based particles, generated by the degradation of the coating. The accumulation of these particles in or on the shaping tools may cause damaging of the shaped parts, by the formation of barbs or contractions. There is also a risk of breakage of the metal sheet if this degradation of the coating shows itself in the form of insufficient slip of the metal sheet in the nip of the shaping tool, even if a lubricating film is previously applied to the surface of the metal sheet.

Finally, there is still a demand by users for further improved resistance to corrosion to be obtained.

SUMMARY OF THE INVENTION

The aim of the invention is to propose treatments by carboxylation of metal surfaces, especially of the layers of zinc and zinc alloy coating galvanized and electrozinced steel sheets, solving more successfully than the existing treatments the problems just mentioned.

To this end, the subject of the invention is a method of conversion by carboxylation of a metal surface selected from zinc, iron, aluminium, copper, lead and their alloys, galvanized or electrozinced, aluminized, or copper-plated steels, under oxidising conditions in relation to the metal, by bringing into contact with an aqueous or hydro-organic bath containing a mixture of organic acids, characterized in that:

- the said organic acids are saturated linear carboxylic acids having 10 to 18 carbon atoms;
- the said mixture is a binary or ternary mixture of such acids;
- the respective ratios of the acids are such that:
- for a binary mixture x±5%–y±5%, x and y being, in molar percentages, the respective ratios of the two acids in a mixture at the composition of the eutectic;
- for a ternary mixture x±3%–y±3%–z±3%, x, y and z being, in molar percentages, the respective ratios of the three acids in a mixture at the composition of the eutectic;
- the concentration of the said mixture in the said bath is 20 g/l or more.

Preferably, for a binary mixture, the respective ratios of the acids are x±3%–y±3%.

The said oxidizing conditions may be created by the presence in the bath of an oxidizing compound for the metal surface.

The said oxidizing compound may be oxygenated water.

The said oxidizing compound may be sodium perborate.

The oxidising conditions may be created by the application of an electrical current to the bath.

The bath may be a hydro-organic bath and contain a co-solvent.

The co-solvent may be selected from 3-methoxy-3-methylbutan-1-ol, ethanol, n-propanol, dimethylsulphoxide, N-methyl-2-pyrrolidone, 4-hydroxy-4-methyl-2-pentanone, and diacetone alcohol.

The said bath may be an aqueous bath and contain a surfactant and/or a dispersant.

The said surfactant may be selected from alkylpolyglycosides, ethoxylated fatty alcohols, ethoxylated fatty acids, ethoxylated oils, ethoxylated nonylphenols, and ethoxylated esters of sorbitan.

The said dispersant may be selected from high molecular weight polyalcohols, salts of carboxylic acids such as (meth) acrylic copolymers, and derivatives of polyamides such as polyamide waxes.

The said saturated carboxylic acids may each have an even number of carbon atoms.

The said saturated carboxylic acids may be lauric acid and palmitic acid.

The said metal surface may be a sheet of galvanised steel, and the bath may contain a complexing agent of $Al^{3+}$.

Preferably, the said mixture is a eutectic mixture.

The invention also has as its subject a method for the temporary protection against corrosion of a metal surface, according to which the conversion of the said surface by carboxylation is carried out, characterized in that the said conversion is carried out by the preceding method.

The said metal surface may be selected from zinc, iron, aluminium, copper, lead and their alloys, galvanized, aluminized and copper-plated steels.

The invention also has as its subject a method for manufacturing a shaped metal sheet having a metal surface selected from zinc, iron, aluminium, copper, lead, and their alloys, and also galvanised, aluminised, and copper-plated steels, wherein a treatment of carboxylation of the said metal sheet is carried out and it is shaped, characterized in that the said carboxylation treatment is carried out by the preceding method.

The said metal sheet may be of steel coated with zinc or with a zinc alloy, and it is shaped by drawing.

As will have been understood, the invention rests on the use, for composing the carboxylation solution or emulsion, of a binary or ternary eutectic of $C_{10}$-$C_{18}$ saturated linear fatty acids, or of a mixture having the composition of such a eutectic. Preferably, the acids used are all acids having an even number of carbon atoms. The binary eutectic of the $C_{12}$-$C_{16}$ acids is particularly preferred. The concentration of the eutectic or of the mixture in the carboxylation bath is 20 g/l or more.

It should be understood that in this description the term "eutectic" designates either a simple mixture at the composition of the eutectic or close to the eutectic containing two or three $C_{10}$-$C_{18}$ saturated linear fatty acids, or a true eutectic having this composition, obtained by melting of the mixture of fatty acids.

Under these conditions it becomes possible, although not obligatory, to dispense with an organic co-solvent, and the treatment bath may contain only the eutectic or the mixture of acids at the composition of the eutectic, a surfactant and water, if the necessary oxidizing conditions are obtained by electrochemical means. That is very advantageous from an ecological point of view. These oxidizing conditions may also be obtained by chemical means, that is, by the addition of an oxidizing compound, such as oxygenated water. It may also be desired to add one or more compounds lowering the pH of the medium, but in the majority of cases the pH of 3 to 5 obtained naturally by the mixture of the compounds that have been cited will be sufficiently acid, especially in the context of the carboxylation of the zinced steel sheets.

The minimum concentration of 20 g/l of the eutectic is selected because, below that limit, the speed of formation of the carboxylated layer is no longer sufficient for an effective conversion layer to be obtained with a length of treatment compatible with industrial requirements.

BRIEF DESCRIPTION OF THE DRAWINGS

The invention will be more easily understood by means of the following description, provided with reference to the appended drawings.

DETAILED DESCRIPTION OF THE INVENTION

Figure 1:
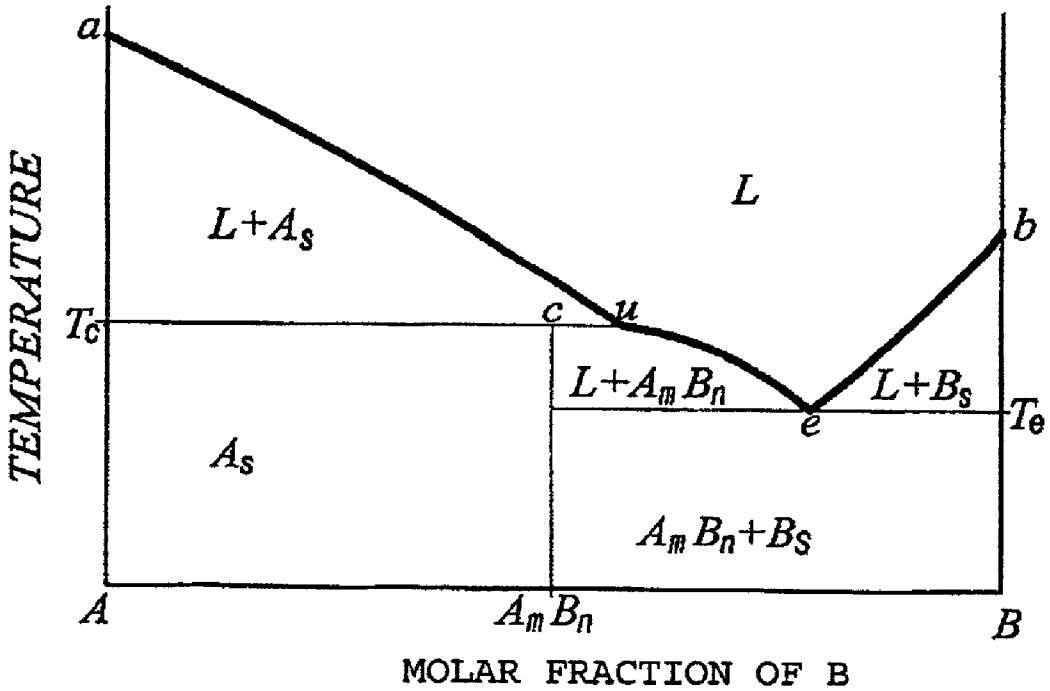
FIG. 1, which shows schematically the diagram of equilibrium of a mixture of two fatty acids A and B in dependence on the temperature.

The principle of the carboxylation of metal surfaces will first be briefly recalled.

The capacity of saturated linear aliphatic monocarboxylates for inhibiting the aqueous corrosion of metals (Cu, Fe, Pb, Zn and Mg) in neutral and aerated solution has been widely demonstrated. The protection obtained is due to the presence of a thin film consisting of crystals of metallic soap and of hydroxide of the metal treated. The protective layer forms under oxidizing conditions and has a resistance to corrosion closely dependent on the length of the carbon chain and on the concentration of the carboxylate.

The carboxylation method, known per se, has been applied primarily to zinc and to zinced coatings. A carboxylation bath contains a $C_n$ saturated linear carboxylic acid, of the general formula ($CH_3(CH_2)_{n+2}COOH$), with $n \geqq 7$, noted as $HC_n$, dissolved in water or in a generally equivolume mixture of water/non-aqueous solvent (ethanol, etc.). An oxidizing agent, such as oxygenated water or sodium perborate, is added to the bath in order to produce at the zinc/solution interface a sufficient quantity of $Zn^{++}$ cations. The pH of the bath is around 5. As a variant, the oxidizing conditions producing the $Zn^{++}$ cations are obtained by causing an electrical current to flow between the surface to be protected and a counter-electrode immersed in the bath.

If the carboxylic acid is noted as $HC_n$, the fundamental reaction of formation of the carboxylated layer at the surface of the zinc is:

$$Zn^{2+}+2C_n^- \rightarrow Zn(C_n)_2\downarrow$$

The compounds usable in the context of the invention, acids as well as surfactants, may come from "green" products, that is, from agricultural production for non-food use (sunflower, linseed, or rapeseed oils, etc.). They advantageously replace the polluting mineral oils used for the lubrication of metal surfaces and the phosphatization and chromatization solutions used for the protection of those same surfaces against corrosion.

The efficiency of the carboxylation treatment has been substantially verified in the case of baths based on saturated linear carboxylic acids having 7 to 18 carbon atoms, and stearic acid $HC_{18}$ has up to now appeared to be a particularly advantageous compound for optimizing the resistance to aqueous corrosion and atmospheric corrosion of zinc soap coatings.

However, the inventors have found that still further improved results, both in terms of protection against corrosion and of behaviour of the carboxylation coating during use (reduction of powdering) could be obtained in the case where use is made of a eutectic or a mixture at the composition of the eutectic of two or three $C_{10}$ to $C_{18}$ saturated linear carboxylic acids, termed "$C_{10}$-$C_{18}$ saturated fatty acids". Such a eutectic or mixture provides a significant improvement in the protection against corrosion in comparison with coatings obtained by means of a single acid or a mixture of acids of a composition not close to a eutectic. In addition, the lubricating properties of these coatings according to the invention are excellent. They make it possible to dispense with oiling of the coated product during its shaping.

Among these saturated fatty acids, those containing an even number of carbon atoms are preferred.

The saturated fatty acids with an even number of carbon atoms usable within the framework of the invention are:

$HC_{10}$ capric acid;
$HC_{12}$ lauric acid;
$HC_{14}$ myristic acid;
$HC_{16}$ palmitic acid;
$HC_{18}$ stearic acid.

A study of their binary mixtures makes it possible to demonstrate the existence of two particular ratios for which appear, respectively, an inflection and a minimum in the curve of the melting point. FIG. 1 shows schematically the diagram of equilibrium of mixtures of fatty acids A and B in dependence on the temperature. The minimum e indicates the formation of a eutectic and the change of slope at the point u is due, generally, to the existence of a molecular compound defined as c of the formula $A_mB_n$ (m and n designate the molar fractions of A and B respectively).

Studies have been carried out on binary mixtures of saturated fatty acids of which one has two more carbon atoms than the other, that is, of the type $HC_n+HC_{n+2}$. In these cases, the eutectic always forms for the composition corresponding to one molecule of the acid with the longest chain to three molecules of the other. Similarly, the break (FIG. 1, point u) corresponding to the complex always appears for a molar ratio of around 1/1.

Figure 2B:
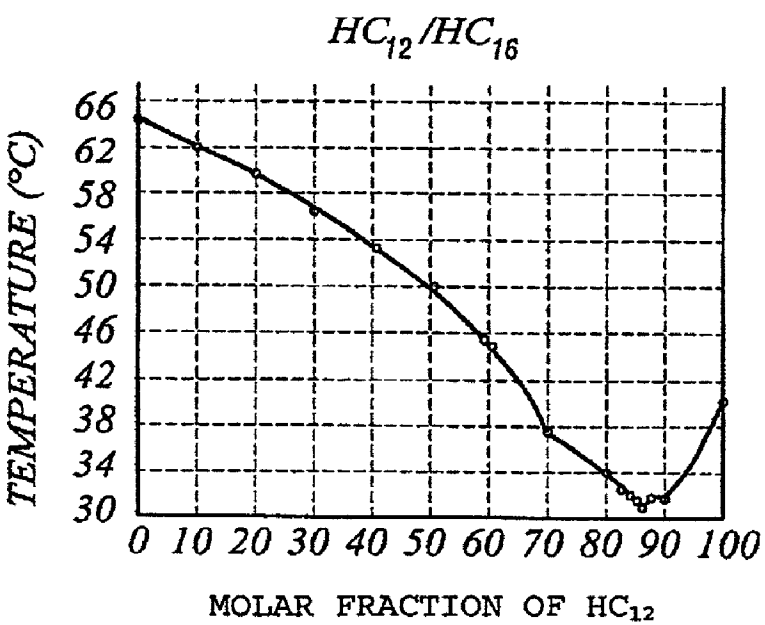
FIG. 2, which shows the binary diagrams of mixtures of $HC_{10}/HC_{12}$ (FIG. 2*a*), $HC_{12}/HC_{16}$ (FIG. 2*b*), $HC_{16}/HC_{18}$ (FIG. 2*c*) and $HC_{12}/HC_{18}$ (FIG. 2*d*) saturated linear fatty acids, without their being dissolved or diluted in water or in a hydro-organic medium.
Figure 2A:
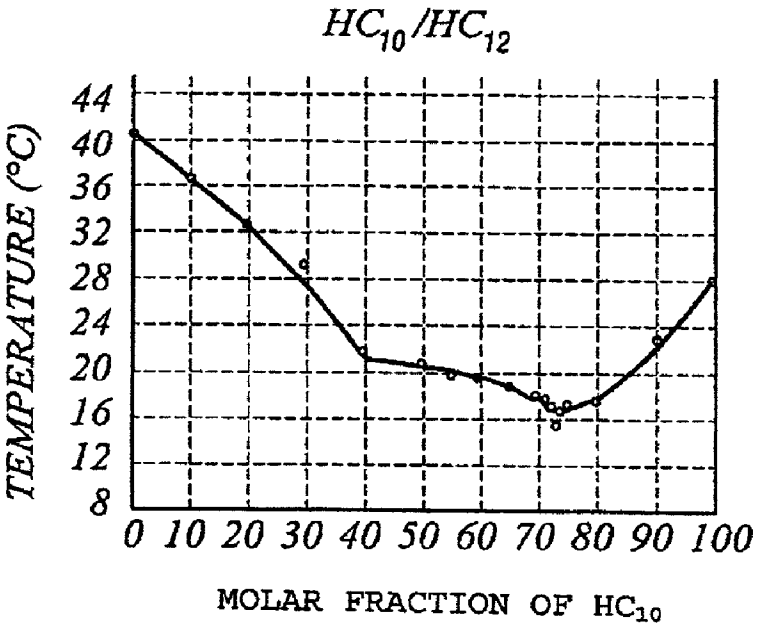
Figure 2D:
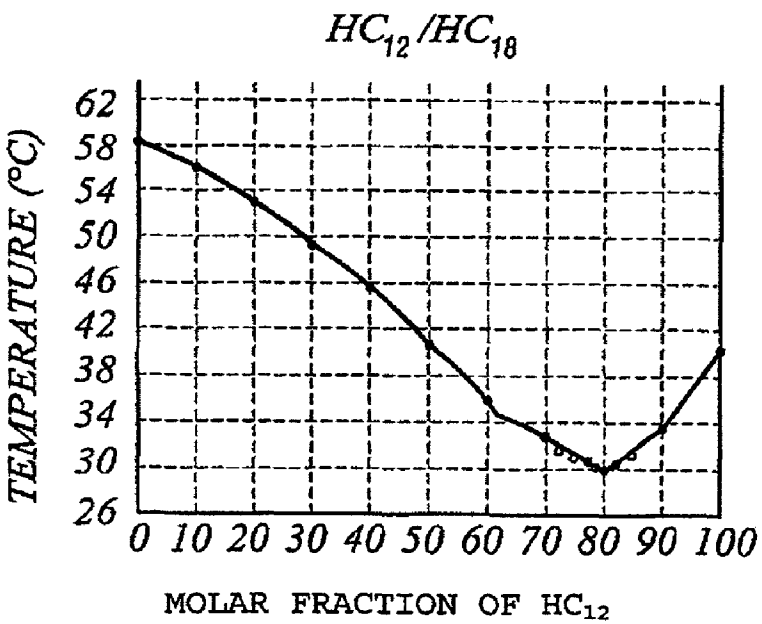
Figure 2C:
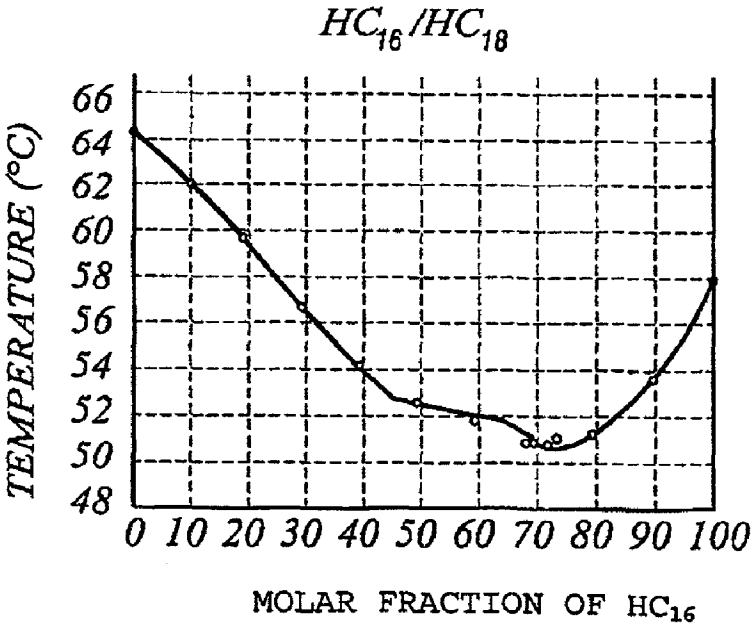

FIGS. 2*b* and 2*d* represent the binary diagrams $HC_{12}/HC_{16}$ and $HC_{12}/HC_{18}$. It is found that the eutectic point e, as well as the inflection point u corresponding to the complex, do not appear respectively at 25 and 50%, as is the case with the mixtures of acids the chain lengths of which differ only by two carbon atoms (FIG. 2*a* for $HC_{10}/HC_{12}$ and FIG. 2*c* for $HC_{16}/HC_{18}$). The eutectic is displaced towards higher molar concentrations of the shortest fatty acid. The form of the binary diagram and the positions of the points u and e are dependent on the more or less limited stability of the complex. The form depends on the difference between the chain lengths of the constituents, and more precisely, on the difference between the melting points of these two fatty acids. Table 1 shows the compositions of the eutectics e of various binary mixtures and their melting points $T_{f(e)}$.

The compositions of the eutectic e given in Table 1 are approximate. According to the publications, they may vary by a few percent. These differences are due to the purity of the fatty acids used.

TABLE 1

Properties of the mixtures of fatty acids studied

| $HC_n$ mixtures | Composition e (mols %) | $T_{f(e)}$ (° C.) |
|---|---|---|
| $HC_{10}/HC_{12}$ | 65/35 | 18 |
| $HC_{12}/HC_{14}$ | 69/31 | 34.2 |

TABLE 1-continued

Properties of the mixtures of fatty acids studied

| $HC_n$ mixtures | Composition e (mols %) | $T_{f(e)}$ (° C.) |
|---|---|---|
| $HC_{12}/HC_{16}$ | 81/19 | 32.7 |
| $HC_{12}/HC_{18}$ | 81.5/18.5 | 37.0 |
| $HC_{14}/HC_{16}$ | 58/42 | 42.6 |
| $HC_{14}/HC_{18}$ | 61/39 | 44.1 |
| $HC_{16}/HC_{18}$ | 72.5/27.5 | 51.1 |

Carboxylation treatments of electrozinced steel sheets on both faces employing these eutectics were carried out.

The metal sheets were degreased in an alkaline degreasing bath, similar to those used in industrial alkaline phosphatization. They were then rinsed. Then the carboxylation treatment took place chemically (presence of an oxidizing agent in the bath, such as oxygenated water or a tetrahydrated sodium perborate) or electrochemically.

The oxidising conditions permit a rapid reaction between $Zn^{2+}$ and $C_n^-$, providing fine crystals of Zn carboxylate.

In the case of the use of an oxidizing agent, experience has shown that oxygenated water and tetrahydrated sodium perborate provide comparable results. The advantages of the use of an oxidizing agent are explained by the increase in the amount of Zn dissolved at the substrate/solution interface, and/or by the local increase in the pH due to the reduction of the following oxidizing agent:

$$BO_3^- + 2H^+ 2e^- \rightarrow BO_2^- + H_2O$$

$$H_2O_2 + 2H^+ 2e^- \rightarrow 2H_2O$$

Concerning the quantity of oxygenated water, this should not be too great in order to obtain good coverage of the surface by the carboxylate crystals. The excess oxygenated water results in more rapid dissolution of the carboxylate in peracid. The concentration of $H_2O_2$ in the solution is, for example, from 2 to 15 g/l. Below 2 g/l the medium is generally not sufficiently oxidizing to form sufficient $Zn^{2+}$ in solution. The duration of the reaction is then likely not to be compatible with industrial requirements. Above 15 g/l, the medium is generally too oxidizing and the crystals form poorly. The optimum concentration is around 8 to 12 g/l of $H_2O_2$ in the solution.

In relation to oxygenated water, sodium perborate has the drawback of less solubility in water. The use of oxygenated water therefore provides a greater flexibility in the choice of concentrations of oxidizing agent.

The preferred co-solvent is 3-methoxy-3-methylbutan-1-ol (MMB). It is a "green" and biodegradable solvent. Moreover, its flashpoint, which is the temperature from which it becomes inflammable, is 71° C., to be compared for example with that of ethanol, which is 12° C. MMB therefore provides better safety conditions than ethanol. It is also possible to use, in particular, ethanol, n-propanol, dimethylsulphoxide, N-methyl-2-pyrrolidone, 4-hydroxy-4-methyl-2-pentanone or diacetone alcohol.

Concerning the use of a eutectic of fatty acids, a first advantage is the lowering of the melting temperature compared with the use of a single fatty acid, as appears from FIG. 2. This makes it possible to maintain the carboxylation bath at a relatively low temperature, of around 45° C. in many cases, particularly if a hydro-organic medium is used.

The eutectic is prepared by the melting over several hours of the mixture of fatty acids of which it is composed. The mixture is then slowly cooled to ambient temperature.

In the examples which have just been described, electrozinced steel sheets (thickness of Zn layer: 7.5 μm) were treated in order to obtain a carboxylated layer weight of between 1 and 2 g/m$^2$, which experience has shown provides a maximum rate of coverage of the metal sheet.

The weight of the carboxylated layer is evaluated by measurement of the difference in mass between the carboxylated substrate and the substrate pickled with dichloroethane by ultrasound, a treatment which involves the dissolution of the carboxylation layer.

The resistance to aqueous corrosion of the test samples was tested in a conventional electrochemical cell with three electrodes, by following the corrosion potential and measuring the polarization resistance. The electrolyte used is water according to standard ASTM D1384-87 (148 mg/l of $Na_2SO_4$, 138 mg/l of $NaHCO_3$, 165 mg/l of NaCl, pH: 7.8). This corrosive solution is customarily used for evaluating the efficiency of corrosion inhibitors in the laboratory.

The resistance to atmospheric corrosion of samples of 50 cm$^2$ was studied according to standard DIN 50017 by means of a climatic enclosure in which the samples were arranged vertically and subjected to cycles of 24 hours, each including, in succession, exposure for 8 hours to a humidity of 100% (bipermutated water at 40° C.) then to ambient air for 16 hours. The degradation of the coating was estimated by visual observation and X-ray diffraction.

The powdering of the samples was evaluated by measurement of the difference in mass of the substrate before and after consecutive passes between two drying rollers. The loss of mass thus measured may be linked to the tendency to powdering of the coating.

Tribologic tests were carried out in order to evaluate the lubricating capacities of the coating during drawing. They were carried out on a plane/plane tribometer with control of the clamping force, by passing the clamped sample of metal sheet at a speed of 1 to 100 mm/sec, and by measuring the development of the distance between the plane tools effecting the clamping of the sample. It is thus possible to determine the coefficient of friction in dependence on the clamping pressure.

In particular, the binary eutectics of the following fatty acids having an even number of carbon atoms were studied:

$HC_{10}/HC_{12}$;
$HC_{12}/HC_{16}$;
$HC_{12}/HC_{18}$.

The coatings obtained with these three eutectics, dissolved in a hydro-organic medium in the presence of oxygenated water, were first studied. The compositions of the baths were as follows:

medium of 50% by volume of water and 50% by volume of 3-methoxy-3-methylbutan-1-ol (MMB);
concentration of $H_2O_2$ 5 g/l;
temperature 45° C.;
compositions and concentrations of the eutectics and duration of carboxylation according to Table 2:

TABLE 2

Compositions and concentrations of the eutectics tested and duration of carboxylation

| Mixture | $\%_{mol}$ eutectic | Concentration (g/l) | Duration of carboxylation (secs) |
|---|---|---|---|
| $HC_{10}/HC_{12}$ | 65/35 | 85 | 4 |
| $HC_{12}/HC_{16}$; | 81/19 | 55 | 4 |
| $HC_{12}/HC_{18}$ | 81.5/18.5 | 45 | 2 |

The dwell times of the samples of metal sheet in the bath were determined so as to obtain a carboxylation layer weight of between 1 and 1.5 g/m$^2$.

Visual observation with a scanning electron microscope shows that each of these deposits provides a satisfactory coverage of the surface of the sample. Small parallelepipedal crystals having a size of between 5 and 10 μm were observed for the eutectics $HC_{12}/HC_{16}$ and $HC_{12}/HC_{18}$. For the eutectic $HC_{10}/HC_{12}$ the crystals are instead spherical or cylindrical.

Analysis of the deposits by X-ray diffraction shows that these deposits are poorly crystallized. This is not in itself a defect for the properties sought, but it complicates the characterisation of the deposits. It was possible, however, to determine, by synthesising the carboxylates of Zn in the form of powder, that the compounds formed have a structure close to $ZnC_{n1}C_{n2}$, $C_{n1}$ and $C_{n2}$ designating the carboxylate ions corresponding to the two acids of the mixture at the composition of the eutectic with $n_1$ and $n_2$ carbon atoms.

Figure 4:
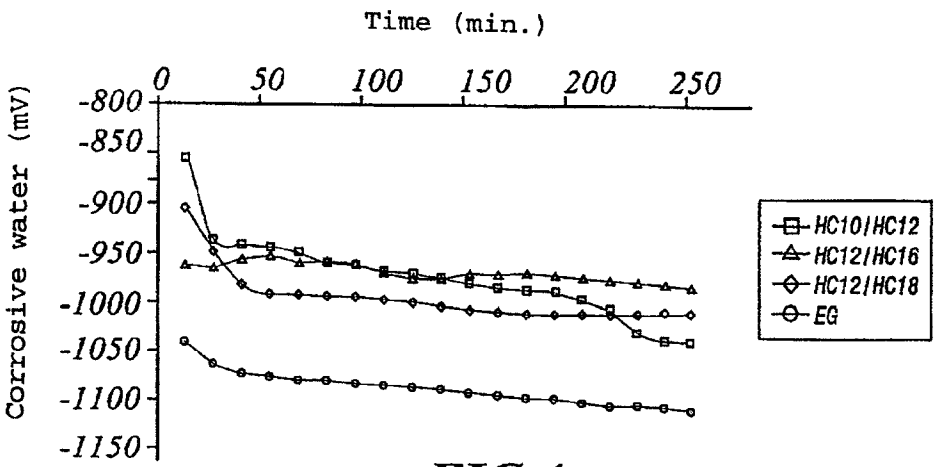
FIG. 4, which shows the development of the corrosion potential over time, under the same conditions as the tests of FIG. 3.
Figure 3:
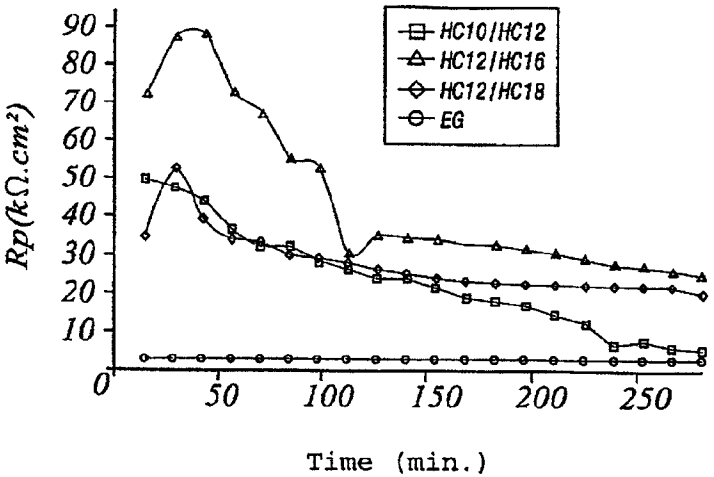
FIG. 3, which shows the development of the polarisation resistance over time for different eutectics and a reference electrozinced metal sheet, carboxylation being carried out in a hydro-organic medium.

FIG. 3 shows the development over time of the polarization resistance $R_p$ of the coatings, and FIG. 4 shows this same development for the corrosion potential $E_{corr}$ in the corrosive water, for the three coatings tested previously defined and, by way of reference, for a non-carboxylated EG electrozinced coating.

It will be seen that the coatings according to the invention exhibit much higher performances than those of the coatings resulting from simple electrozincing. For these, the polarization resistance is of the order of 2 k□·cm$^2$, and the carboxylation coatings produced customarily by means of water/solvent solutions based on a single fatty acid provide only a relatively slight improvement on that value (up to 15 k□·cm$^2$). On the other hand, the coatings according to the invention provide values of the order of 5 to 15 times higher than those observed for only electrozinced coatings. The coatings obtained by means of $HC_{12}/HC_{16}$ in the first place, and by means of $HC_{12}/HC_{18}$ in the second place, provide the best results in absolute value and stability over time. As to the corrosion potentials, those of the coatings according to the invention are 80 to 140 mV more than the values obtained for the electrozinced coating. There again, $HC_{122}/HC_{16}$ gives the best result. The coatings obtained by means of a single fatty acid in a water/solvent medium customarily provide corrosion potentials of the order of −1020 to −1080 mV, therefore less favourable than those of the coatings according to the invention.

The resistance to atmospheric corrosion was also estimated by observing the percentage of the surface area of the sample that was corroded at the end of 20 cycles of exposure, such as defined previously.

Whilst 100% of the surface area of the electrozinced sample was corroded at the end of 10 cycles, no degradation was observed after 20 cycles for the mixture $HC_{12}/HC_{16}$ which gave the best performances. For the other mixtures, the surface area corroded after 20 cycles represents around 7% (for $HC_{10}/HC_{12}$) and 10% (for $HC_{12}/HC_{18}$) of the total surface area. These performances are comparable to or better than those obtained by means of single fatty acids in an organic water/solvent medium.

Moreover, no recrystallized corrosion product was observed with X-ray diffraction.

Figure 5:
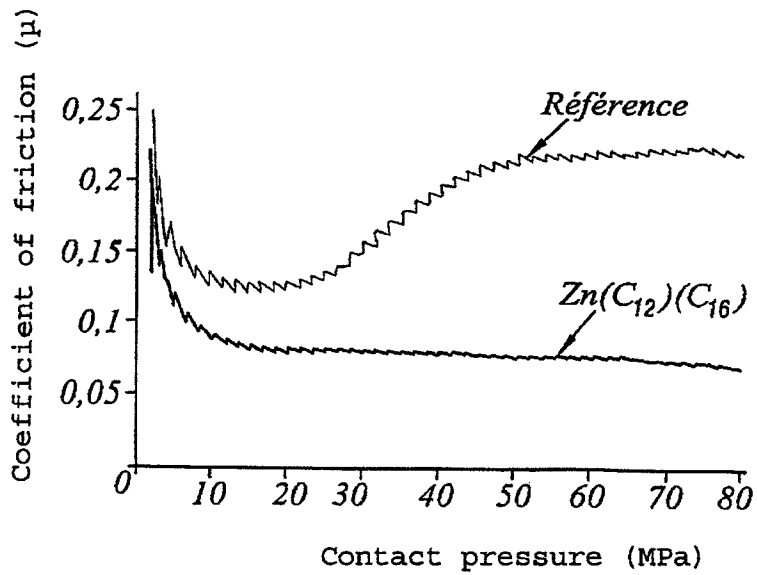
FIG. 5, which shows the results of tribologic tests carried out on a sample of electrozinced metal sheet carboxylated by an $HC_{12}/HC_{16}$ eutectic and on a reference sample.

Tribology tests were carried out on the coating formed by means of $HC_{12}/HC_{16}$ in comparison with an electrozinced coating. The result is shown in FIG. 5, which shows the coefficient of friction of the coating in dependence on the contact pressure for the two coatings. The tribologic behaviour of the non-coated electrozinced steel degrades noticeably with the increase in the contact pressure, which is not the case with the coating according to the invention, which constantly exhibits a low coefficient of friction, of the same order of magnitude as that of the coatings formed by means of single fatty acids. This coating proves well suited for use as a lubricant during the drawing of a steel sheet coated with zinc or zinc alloy.

It was also found that this coating is not very subject to powdering. After 20 passes on the drying rollers, a loss of layer weight of 0.2 g/m$^2$ was measured, as against 0.4 g/m$^2$ for a steel coated with a conversion layer of $Zn(C_7)_2$.

Generally, the carboxylation coatings obtained by means of binary mixtures of fatty acids at the composition of the eutectic have performances at least equal, and often superior from all points of view, to those of coatings obtained by means of single fatty acids in a water/solvent medium. Overall, the mixture $HC_{12}/HC_{16}$ is the most satisfactory of those which were tested.

Complementary tests were able to show that in the process of preparation of the samples, a refining step making it possible to activate the metal surface to be treated did not provide a significant improvement in the quality of the carboxylation coating formed during the following step. It may therefore generally be omitted without major drawbacks, which is very advantageous from the economic and ecological point of view.

Other tests also showed that the invention can also profitably be applied to galvanized coatings. In this case it is necessary, however, to eliminate the layer of aluminium $Al_2O_3$ customarily present on the surface of the coating, since this reduces the reactivity of the surface and inhibits the dissolution of the zinc. That may be achieved by adding complexing agents of $Al^{3+}$ to the conversion bath, such as NaF, diethylenediaminetetracetic acid (EDTA), nitrilotriacetic acid NTA, citrates, oxalates, certain amino acids, or an oxalic acid and aluminium phosphate mixture.

Another method consists in preparing the surface prior to carboxylation by eliminating the layer of $Al_2O_3$:

- by alkaline degreasing (NaOH, surfactants, complexing agents) in order to dissolve the $Al_2O_3$, followed by alkaline oxidation (NaOH, iron and cobalt salts, complexing agents) which completes the elimination of $Al_2O_3$ and precipitates a fine layer containing Fe and Co which improves the dissolution of the zinc during conversion;
- or by an acid attack ($H_2SO_4$) in the presence of Ni ions; the Ni precipitates on the substrate in the metallic state and accelerates the dissolution of the zinc during conversion.

Moreover, tests were carried out on the mixture $HC_{12}/HC_{16}$ with compositions deviating from the eutectic 81-19%. It appears that the 77/23% and 85/15% mixtures already have degraded properties in relation to the eutectic 81/19%, concerning in particular the polarization resistance. These performances, however, remain superior to those obtained with the solutions containing $HC_{12}$ or $HC_{16}$ alone.

Generally, it is considered that the deviation in composition (in mols %) in relation to the eutectic x %−y % should not exceed x±5%−y±5% and preferably x±3%−y±3%, for the binary eutectics or x±3%−y±3%−z±3% for the ternary eutectics.

Moreover, there is a need to have available a method wherein the fatty acids would not require the presence of an organic solvent in the carboxylation medium. To this end, it was found especially with the eutectic $HC_{12}/HC_{16}$ 81/19% that it was possible to obtain good results by omitting the organic solvent and adding a surfactant and/or a dispersant to the carboxylation bath.

It is then necessary to provide for a rinsing step to eliminate the surfactant, which is hydrophilic, in order to restore the hydrophobic nature of the layer of Zn carboxylate, and thus avoid corrosion of the metal sheet.

As surfactants, very varied compounds were used, generally selected from non-ionic surfactants, and especially:

- alkylpolyglycosides (APG) such as Agrimul PG 215 CS VP and Glucopon 225 DK/HH of the company COGNIS; these surfactants are based on sugar, are non-toxic and have an exceptional resistance to alkaline agents and salts;
- ethoxylated fatty alcohols such as Brij 58 of the company ACROS;
- saturated or unsaturated ethoxylated fatty acids;
- ethoxylated oils;
- ethoxylated nonylphenols;
- ethoxylated esters of sorbitan.

As dispersants it is possible to use, in particular, high molecular weight polyalcohols, salts of carboxylic acids such as (meth)acrylic copolymers, derivatives of polyamides such as polyamide waxes.

Under these conditions, the optimum for the concentration of oxygenated water is between 2 and 8 g/l.

With single fatty acids, carboxylation without an organic solvent by means of a simple aqueous emulsion does not provide optimal coatings for protection against corrosion, since the weight of the carboxylation layer is relatively low. It was therefore determined whether the use of eutectics of fatty acids under these conditions could prove more satisfactory.

Carboxylation emulsions were thus prepared containing water, the aforesaid surfactant APG 215 and the eutectic $HC_{12}/HC_{16}$ at 81/19%.

It was established that at 45° C. it was possible to obtain an emulsion stable for at least 1 hour containing up to at least 6% of APG 215 and up to 4% of eutectic. The percentages for the surfactant and the eutectic are percentages by mass.

The following experiments were carried out with an emulsion containing 3% of eutectic and 0.1 to 3% of APG 215, in the presence of 5 or 10 g/l of oxygenated water.

The emulsions tested had the following compositions:

A: water —$HC_{12}/HC_{16}$ 3%–APG 215 0.1%–$H_2O_2$ 5 g/l

B: water —$HC_{12}/HC_{16}$ 3%–APG 215 1%–$H_2O_2$ 5 g/l

C: water —$HC_{12}/HC_{16}$ 3%–APG 215 3%–$H_2O_2$ 5 g/l

D: water —$HC_{12}/HC_{16}$ 3%–APG 215 3%–$H_2O_2$ 10 g/l

It was found that the emulsion A with a low concentration of APG 215 makes it possible to release the fatty acids more rapidly. A layer weight of 1.2 g/m$^2$ is achieved in 5 secs., while 10 secs. are necessary to reach a layer weight comparable to the other emulsions. For APG 215 contents of 1 to 3%, no very marked effect of the concentration of surfactant was observed. Nor did the concentration of oxidizing agent have a very noticeable effect within the range explored.

The size of the crystals does not seem to be linked to the composition of the emulsion. There again, the product of carboxylation is not well crystallised, and its composition is close to $ZnC_{12}C_{16}$.

Figure 6:
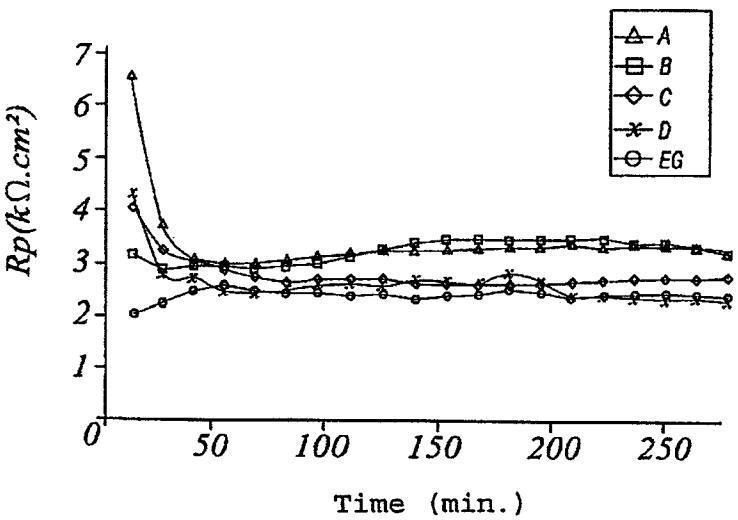
FIG. 6, which shows the results of tests similar to those of FIG. 3, carried out in a water+surfactant medium.
Figure 7:
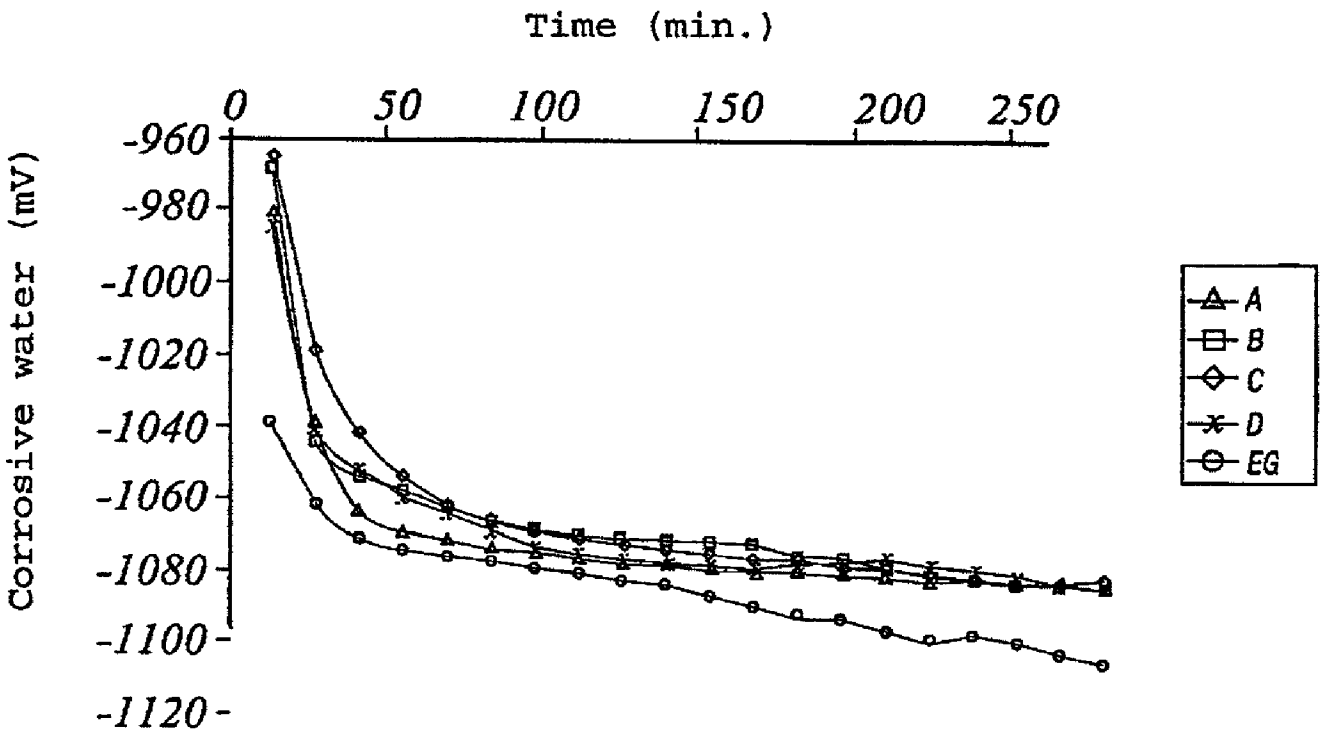
FIG. 7, which shows the results of tests similar to those of FIG. 4, carried out in a water+surfactant medium.

Measurements were made of the polarization resistance and of the corrosion potential under the same conditions as previously, and these were compared with those obtained on an electrozinced EG coating. The results were illustrated in FIGS. 6 and 7 respectively.

It appears that for aqueous corrosion, all the coatings provide a greater polarization resistance than that of the electrozinced coating alone during the first minutes of immersion, then stabilize at values equal to or slightly above that of the electrozinced coating. The emulsions less rich in surfactant provide the best results. For the corrosion potential, the different coatings have comparable behaviours and provide a more favourable corrosion potential than that of the electrozinced metal sheet.

For atmospheric corrosion, it is the emulsions C and D, the richest in surfactant, which give the best results, with respectively 10 and 20% of the surface area corroded at the end of 20 cycles. The results for tribology are likewise favorable.

A mixture $HC_{12}/HC_{16}$ in respective molar ratios of 77 and 23% was also prepared (therefore deviating slightly from the eutectic 81-19%, but remaining according to the invention) in a water/solvent medium (MMB).

This mixture was brought into the form of a eutectic by melting, as indicated previously, and two carboxylation solutions were produced using this eutectic mixture.

Solution 1: 50% water+50% solvent by volume, to which is added 4% of the eutectic by mass+0.095 g/l of Al phosphate+0.105 g/l of oxalic acid+5 g/l of $H_2O_2$.

Solution 2: 50% water+50% solvent by volume, to which is added 4% of the eutectic by mass+0.1 g/l of Al oxalate+5 g/l of $H_2O_2$.

Solubilization took place at 45° C.

Figure 8:
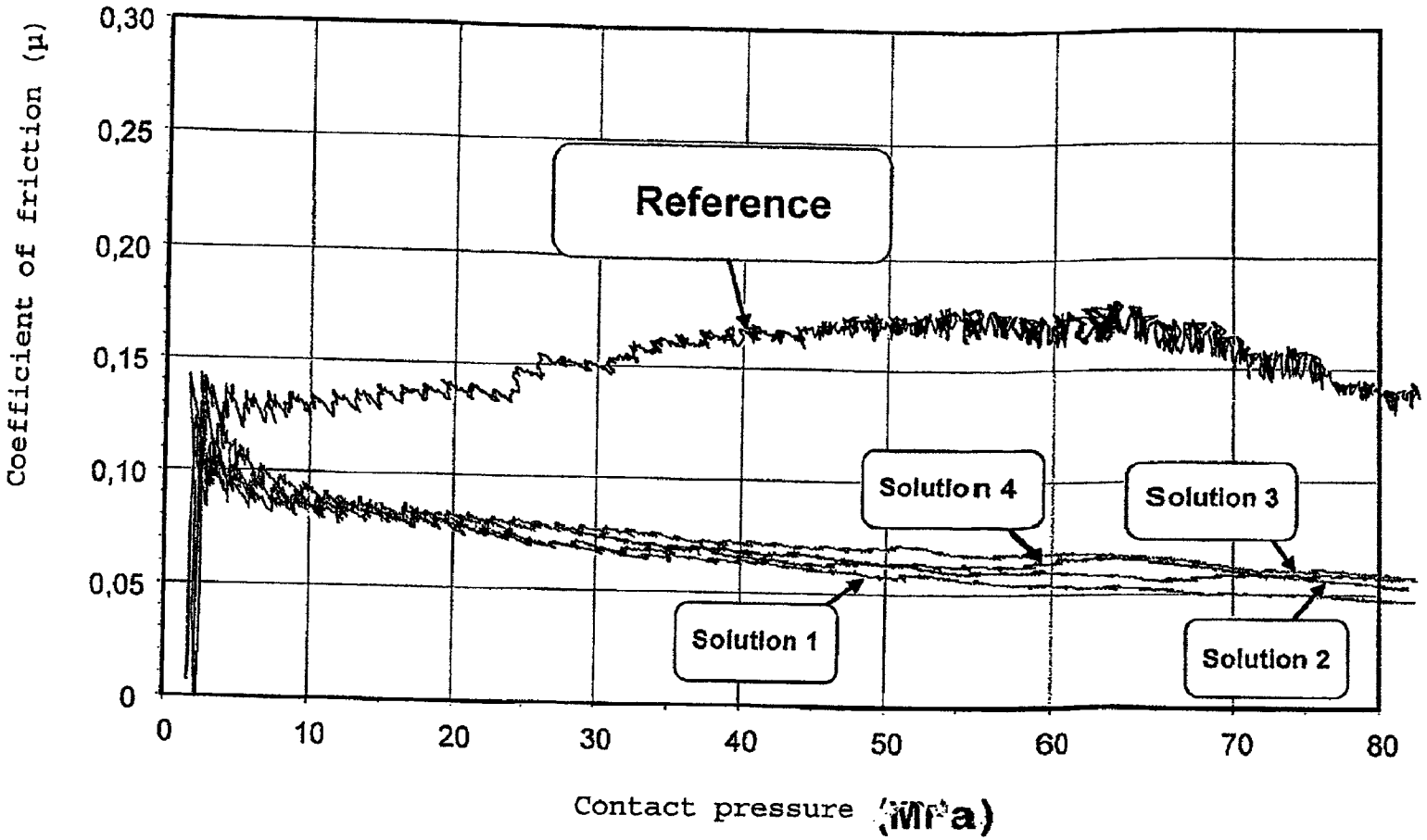
FIG. 8, which shows the results of tribologic tests carried out on a sample of dip-galvanised metal sheet carboxylated by an $HC_{12}/HC_{16}$ eutectic or a $HC_{12}/HC_{16}$ mixture and on a reference sample.

These solutions were then applied to the carboxylation of dip-galvanized metal sheets, the galvanization layer having a thickness of 8 μm, and an Al content of 0.2 to 0.4% by weight, and galvanization having been carried out with a Zn bath at 450° C. The results of the tribology tests then carried out are shown in FIG. 8, and also those obtained for a non-carboxylated reference sample of galvanized metal sheet.

This reference sample has a coefficient of friction of the order of 0.13 to 0.17 according to the contact pressure.

The carboxylated metal sheets according to the invention have coefficients of friction that can go as low as 0.05μ, and always very substantially lower, with equal contact pressure, than those of the reference metal sheets. It will also be seen that the replacement of the mixture of Al phosphate+oxalic acid (solution 1) by Al oxalate (solution 2) has no significant influence on the tribologic properties. Nor does the fact that the composition of the mixture deviates slightly from that given as being that of the eutectic (in the range of ±5% for each constituent) compromise the good quality of the result.

It was also determined that the use of a mixture $HC_{12}/HC_{16}$ in these same ratios but not previously brought into the form of a eutectic gave results comparable to the previous ones. The solutions 3 and 4, corresponding respectively to compositions identical to those of solutions 1 and 2, were thus tested.

As will be seen in FIG. 8, the results of the tribology tests obtained with solutions 3 and 4 are not significantly distinguishable from those obtained with solutions 1 and 2 which contained true eutectics.

Likewise, all the solutions 1 to 4 provided a covering and homogeneous deposit. The weight of the layer formed reached 1.2 g/m$^2$ at the end of 3 to 7 secs. in all cases.

For all these coatings, no corrosion was observed after 18 cycles of exposure under the conditions seen previously.

To sum up, the performances of the carboxylation coatings formed starting from eutectics or from mixtures at the composition of the eutectic in an organic water/solvent medium are generally superior to those of the similar coatings formed by emulsions in a water/surfactant medium. However, when the performances of the coatings formed without organic solvent are judged sufficient, for example because the products coated are not intended to remain for a long time in a corrosive atmosphere, it is advantageous to use them, since the toxicological risks are lower for the handlers and for the environment. In addition, their use requires little or no checking and after-treatment of the effluents.

In the experiments which have been described, the oxidizing conditions were obtained by means of oxygenated water. But, as is known, they could have been obtained with other oxidizing agents, or by the application to the carboxylation bath of an electrical current having a strength of the order of, for example, from 10 to 25 mA/cm$^2$.

The invention is not limited to the examples which have been described. In particular, the eutectics of the other pairs of $C_{10}$-$C_{18}$ saturated linear fatty acids would be usable, whether these acids each had an even or an odd number of carbon atoms. It is also possible to use eutectics of ternary mixtures of such fatty acids.

However, it is the use of fatty acids having an even number of carbon atoms which constitutes the preferred mode of implementation of the invention. These even fatty acids are of vegetable origin and generally arise from "green" products, from renewable sources. The odd fatty acids do not exist in nature and have to be synthesized. In addition, the eutectics of odd fatty acids require chemical treatments for their preparation.

The conversion baths may contain, optionally:

- agents for regulating the pH or buffer agents for regulating the conditions of formation of the conversion layer on the surface;
- additives facilitating the implementation of the treatment and the distribution of the bath on the surface to be treated, such as surfactants (it being understood that the presence of a surfactant is obligatory when the bath is an aqueous emulsion);
- additives making it possible to prolong the life of the bath such as, for example, chelating agents for retarding the precipitation of compounds other than those which it is desired to obtain in the conversion layer, or bactericidal agents;
- treatment accelerating agents; and
- additives permitting the dispersion of the fatty acids in an aqueous medium.

The conversion treatments according to the invention are applicable to metal surfaces other than zinced steels. They may relate to any metal surface capable of undergoing carboxylation, i.e. zinc, iron, aluminium, copper, lead and their alloys, and aluminised or copper-plated steels.

The invention claimed is:

1. A method of conversion by carboxylation of a metal surface selected from the group consisting of zinc, iron, aluminium, copper, lead and their alloys, and galvanized, electrozinced, aluminized, and copper-plated steels, under oxidizing conditions in relation to the metal surface, by bringing said metal surface into contact with a aqueous or hydro-organic bath containing a mixture of organic acids, said mixture being such that:

- said organic acids are saturated linear carboxylic acids having from 10 to 18 carbon atoms,
- said mixture is a binary or ternary mixture of said organic acids,
- said mixture is present in said bath in a concentration of 20 g/l or more,
- said organic acids are present in said mixture in respective ratios such that:
  - for a mixture of two acids, the deviation in composition does not exceed 5% in relation to a binary eutectic x/y, x and y being, in molar percentages, the respective ratios of said two acids in said binary eutectic,
  - for a mixture of three acids, the deviation in composition does not exceed 3% in relation to a ternary eutectic x/y/z, x, y and z being, in molar percentages, the respective ratios of said three acids in said ternary eutectic.

2. A method according to claim 1, wherein said mixture is binary and said deviation does not exceed 3% of said respective ratios.

3. A method according to claim 1, wherein said oxidizing conditions are created by the presence of an oxidizing compound for the metal surface in said bath.

4. A method according to claim 3, wherein said oxidizing compound is oxygenated water.

5. A method according to claim 3, wherein said oxidizing compound is sodium perborate.

6. A method according to claim 1, said oxidizing conditions are created by application of an electrical current to the bath.

7. A method according to claim 1, wherein said bath is a hydro-organic bath and contains a co-solvent.

8. A method according to claim 7, wherein said co-solvent is selected from the group consisting of 3-methoxy-3-methylbutan-1-ol, ethanol, n-propanol, dimethylsuphoxide, N-methyl-2-pyrrolidone, 4-hydroxy-4-methyl-2-pentanone, and diacetone alcohol.

9. A method according to claim 1, wherein said bath is an aqueous bath and additionally contains a surfactant and/or a dispersant.

10. A method according to claim 9, wherein said surfactant is selected from the group consisting of alkylpolyglycosides, ethoxylated fatty alcohols, ethoxylated fatty acids, ethoxylated oils, ethoxylated nonylphenols, and ethoxylated esters of sorbitan.

11. A method according to claim 9, wherein said dispersant is selected from the group consisting of high molecular weight polyalcohols, salts of carboxylic acids such as (meth) acrylic copolymers, and derivatives of polyamides such as polyamide waxes.

12. A method according to claim 1, wherein said saturated carboxylic acids each have an even number of carbon atoms.

13. A method according to claim 12, wherein said saturated carboxylic acids are lauric acid and palmitic acid.

14. A method according to claim 1, wherein said metal surface is a sheet of galvanized steel, and said bath additionally contains a complexing agent of $Al^{3+}$.

15. A method according to claim 1, wherein said mixture is a true eutectic mixture.

16. A method for temporary protection against corrosion of a metal surface, according to which a conversion of said metal surface by carboxylation is carried out by the method according to claim 1.

17. A method according to claim 16, wherein said metal surface is selected from the group consisting of zinc, iron, aluminium, copper, lead and their alloys, and galvanized, aluminized and copper-plated steels.

18. A method for manufacturing a shaped metal sheet having a metal surface selected from the group consisting of zinc, iron, aluminium, copper, lead and their alloys, and galvanized, aluminized, and copper-plated steels, wherein a treatment of carboxylation of said metal sheet is carried out according to claim 1 and the metal sheet is subsequently shaped.

19. A method according to claim 18, wherein said metal sheet is steel coated with zinc or with a zinc alloy, and wherein said metal sheet is shaped by drawing.

* * * * *